US011952156B2

(12) United States Patent
Otxoa-Aizpurua Calvo et al.

(10) Patent No.: US 11,952,156 B2
(45) Date of Patent: Apr. 9, 2024

(54) VERTICAL PACKAGING MACHINE FOR PACKAGING PRODUCTS IN A MODIFIED ATMOSPHERE

(71) Applicant: ULMA Packaging, S. Coop., Oñati (ES)

(72) Inventors: Alberto Otxoa-Aizpurua Calvo, Oñati (ES); Eneko Izquierdo Ereño, Oñati (ES)

(73) Assignee: ULMA Packaging, S.Coop., Oñati (ES)

( * ) Notice: Subject to any disclaimer, the term of this patent is extended or adjusted under 35 U.S.C. 154(b) by 400 days.

(21) Appl. No.: 17/394,082

(22) Filed: Aug. 4, 2021

(65) Prior Publication Data

US 2021/0362895 A1 Nov. 25, 2021

Related U.S. Application Data

(63) Continuation of application No. PCT/ES2020/070202, filed on Mar. 24, 2020.

(30) Foreign Application Priority Data

Apr. 4, 2019 (EP) ..... 19382251

(51) Int. Cl.
*B65B 31/04* (2006.01)
*B65B 9/087* (2012.01)
(Continued)

(52) U.S. Cl.
CPC ..... *B65B 31/045* (2013.01); *B65B 9/087* (2013.01); *B65B 51/30* (2013.01); *B65B 61/06* (2013.01)

(58) Field of Classification Search
CPC ..... B65B 31/045; B65B 51/20; B65B 9/087; B65B 9/20; B65B 61/06
See application file for complete search history.

(56) References Cited

U.S. PATENT DOCUMENTS 3,664,086 A * 5/1972 James ..... B65B 55/19 53/511
6,116,001 A 9/2000 Kammler et al.
(Continued)

FOREIGN PATENT DOCUMENTS

CH 554258 A 9/1974
FR 2873655 A1 2/2006

OTHER PUBLICATIONS

European Search Report in corresponding European Patent Application No. EP19382251.7, dated Sep. 30, 2019.
(Continued)

*Primary Examiner* — Thomas M Wittenschlaeger
(74) *Attorney, Agent, or Firm* — Edell, Shapiro & Finnan, LLC

(57) ABSTRACT

A vertical packaging machine for packaging products in a modified atmosphere. According to one embodiment, the vertical packaging machine includes a hopper through which the products to be packaged are introduced, a hollow forming element arranged downstream of the hopper, at least the hopper and the forming element forming a supply conduit through which the product to be packaged falls. The vertical packaging machine also includes an injection device configured for injecting a gaseous fluid into the supply conduit. A gas supply source is communicated with the inside of the supply conduit, the gas supplied to the supply conduit being suitable for packaging products in a modified atmosphere. A supply unit communicates the gas source with the inside of the supply conduit.

18 Claims, 3 Drawing Sheets

(51) Int. Cl.
*B65B 51/30* (2006.01)
*B65B 61/06* (2006.01)

(56) References Cited

U.S. PATENT DOCUMENTS

| | | | | |
|---|---|---|---|---|
| 6,179,015 | B1 | 1/2001 | Kammler et al. | |
| 2013/0091806 | A1* | 4/2013 | Williams | B65B 1/04 222/630 |
| 2018/0354665 | A1 | 12/2018 | Otxoa-Aizpurua Calvo et al. | |

OTHER PUBLICATIONS

International Search Report and Written Opinion in corresponding Int'l Patent Application No. PCT/ES2020/070202, dated Jul. 21, 2020.

* cited by examiner

VERTICAL PACKAGING MACHINE FOR PACKAGING PRODUCTS IN A MODIFIED ATMOSPHERE

CROSS-REFERENCE TO RELATED APPLICATIONS

This application relates to and claims the benefit and priority to International Application No. PCT/ES2020/070202, filed Mar. 24, 2020, which claims the benefit and priority to European Application No. EP19382251.7, filed Apr. 4, 2019.

TECHNICAL FIELD

The present invention relates to vertical packaging machines, and more specifically to vertical packaging machines for packaging products in a modified atmosphere.

BACKGROUND

Certain types of conventional product packaging machines, particularly vertical packaging machines, comprise a feeder whereby a continuous film which is wound like a spool is supplied. The film is supplied to a vertical forming element which forms said film into a tubular shape. The machine also comprises a drive device for driving the tubular-shaped film in a descending forward movement direction, around the forming element, and at least one longitudinal sealing tool sealing the longitudinal ends of the tubular-shaped film together, a film tube thereby being generated. The forming element is open at its upper and lower parts.

A machine of this type further comprises a transverse sealing and cutting tool, arranged downstream of the forming element, for generating a transverse seal and a transverse cut on the film tube. After this operation (or operations), a tube closed at one end is obtained upstream of the transverse cut and a closed package at both ends downstream of the transverse cut and physically separated from the film tube is obtained. During said operation (or operations), the end farther upstream of the package is closed, whereas the closed end farther downstream of the package corresponds with the closed end of the film tube of the previous cycle, i.e., the transverse seal which closes one end of the film tube will be a closed end of the package attained in the next cycle.

The machine also comprises a hopper or a similar device upstream of the forming element, from where the product to be packaged is introduced into the forming element, which product is arranged on the transverse seal of the film tube closed at one end after falling through the forming element. The product is introduced into the forming element through its upper part, and exits through its lower part towards the transverse seal of the film tube. It must be kept in mind that the film tube surrounds the forming element, such that when the product is introduced into the forming element, it is also introduced into the film tube.

The product is generally supplied in a controlled manner, a predetermined amount corresponding with the amount of product to be packaged in each package being supplied each time. Some products, particularly food products, require modified atmosphere packaging. This involves the presence of a gas suitable for performing this type of packaging in the final package generated, together with the product, and when this gas is introduced, the atmosphere in which the product is packaged is modified (hence it is known as modified atmosphere packaging). Two ways of performing packaging of this type in vertical machines are known.

One way is by means of using elements coaxial as a forming element. The forming element comprises two concentric elements of different diameters, with a space being defined therebetween, said space being open at the lower end of the forming element. The gas required for modified atmosphere packaging in the film tube is introduced through this space, such that the generated packages comprise said gas therein when they are sealed and cut transversely.

Another way is by means of using an element commonly known as a nozzle. The nozzle is a hollow element extending vertically inside the forming element and the lower end of which projects below said lower element. The gas required for modified atmosphere packaging is introduced through said nozzle.

In both cases, gas is introduced in the film tube during the supply of the product to be packaged. This does not entail any drawbacks for the conventional packaging of products, and is a common practice. However, it is becoming increasingly more common to use methods to accelerate the packaging of the products for the purpose of reducing packaging time and/or for compacting the products to be packaged, and/or for saving in packaging material. In these cases, it is common to use during the packaging method streams of fluid which attack the product in some way, which involves the acceleration of their fall through the forming element and/or the compaction at the end of the fall.

U.S. Pat. No. 6,179,015 B1 discloses a machine of this latter type. To accelerate the fall of the product, or to compact the product at the closed end of the film tube, air is injected into the film tube at certain time intervals in a controlled manner by means of a control device. The control device controls the injection of air depending on the position of the product being fed from the hopper, injecting air once the product has been introduced in the forming element and said injection pulling the product therein below the injection point or area. The drawback of these machines is that if modified atmosphere packaging is to be combined with the acceleration and/or compaction of the product to be packaged, there is a risk of causing the product to scatter once it is compacted due to the gas stream that is introduced through a nozzle or through a coaxial tube, or if this scattering is to be prevented, said gas will have to be injected slowly, which would entail an increase in packaging time and, therefore, a loss of productivity.

SUMMARY

Disclosed is a vertical packaging machine for packaging products in a modified atmosphere. According to one embodiment, the vertical packaging machine comprises:

- a hopper through which the products to be packaged are introduced in a downward supply direction,
- a hollow forming element arranged downstream of the hopper in the supply direction and aligned with said hopper in said supply direction, at least the hopper and the forming element forming a supply conduit through which the product to be packaged falls in the supply direction,
- a feeder for feeding a continuous film around the forming element, the forming element imparting a tubular shape to said film,
- a longitudinal sealing tool configured for longitudinally sealing together the longitudinal ends of the tubular-shaped film, generating a film tube, a transverse sealing and cutting tool arranged downstream of the forming element in the supply direction and configured for transversely sealing and cutting the film tube, obtaining a transversely closed film tube upstream of the transverse cut and a closed package physically separated from the film tube downstream of said transverse cut, and an injection device configured for injecting a gaseous fluid into the supply conduit.

The injection device is configured for causing a Venturi effect inside the supply conduit when it injects the gaseous fluid into said supply conduit. When gaseous fluid is injected with the injection device, a negative pressure is generated in the supply conduit, above the point (or points) where said fluid is introduced, injected into the supply conduit. This negative pressure causes a suctioning of what it is in the supply conduit above said negative pressure to compensate it, such that the fluid present in the supply conduit above said negative pressure and the product to be packaged which may be upstream of said negative pressure, are suctioned out. What has been suctioned out is thereby led to the lower end of the forming element, following the injected fluid (pushing down anything that may be in the actual area where the negative pressure has been created and anything that may be above the lower area of the hopper).

The machine further comprises a gas supply source communicated with the inside of the supply conduit and comprising therein a gas suitable for packaging products in a modified atmosphere, and a supply unit communicated with the supply source and with the inside of the supply conduit, such that the gas suitable for packaging products in a modified atmosphere can reach said supply conduit through the supply unit and can be used to perform modified atmosphere packaging (known as MAP).

The supply conduit comprises at least one supply port through which gas is fed from the supply unit into the supply conduit. The supply port is arranged upstream of said inlet point or area, and this arrangement allows, when the injection device injects the gaseous fluid into the supply conduit, said injection to cause the gas to be suctioned from the supply unit into the supply conduit. Said suction forces the entry of the gas into the supply conduit from the supply unit.

Therefore, as a result of the proposed machine, in addition to accelerating the fall of the product, the injection of the gaseous fluid by the injection device causes gas to be entrained or suctioned from the supply unit to the supply conduit, obtaining the packaging of products in a modified atmosphere without affecting machine productivity, and, where appropriate, product compaction achieved as a result of the injection of the gaseous fluid. This is furthermore achieved by dispensing with conventional solutions for packaging products in a modified atmosphere, which require the use of a nozzle or a coaxial forming element like those described above for introducing the gas, in addition to the aforementioned drawbacks being overcome.

These and other advantages and features will become apparent in view of the drawings and the description detailed description.

DETAILED DESCRIPTION

Figure 1:
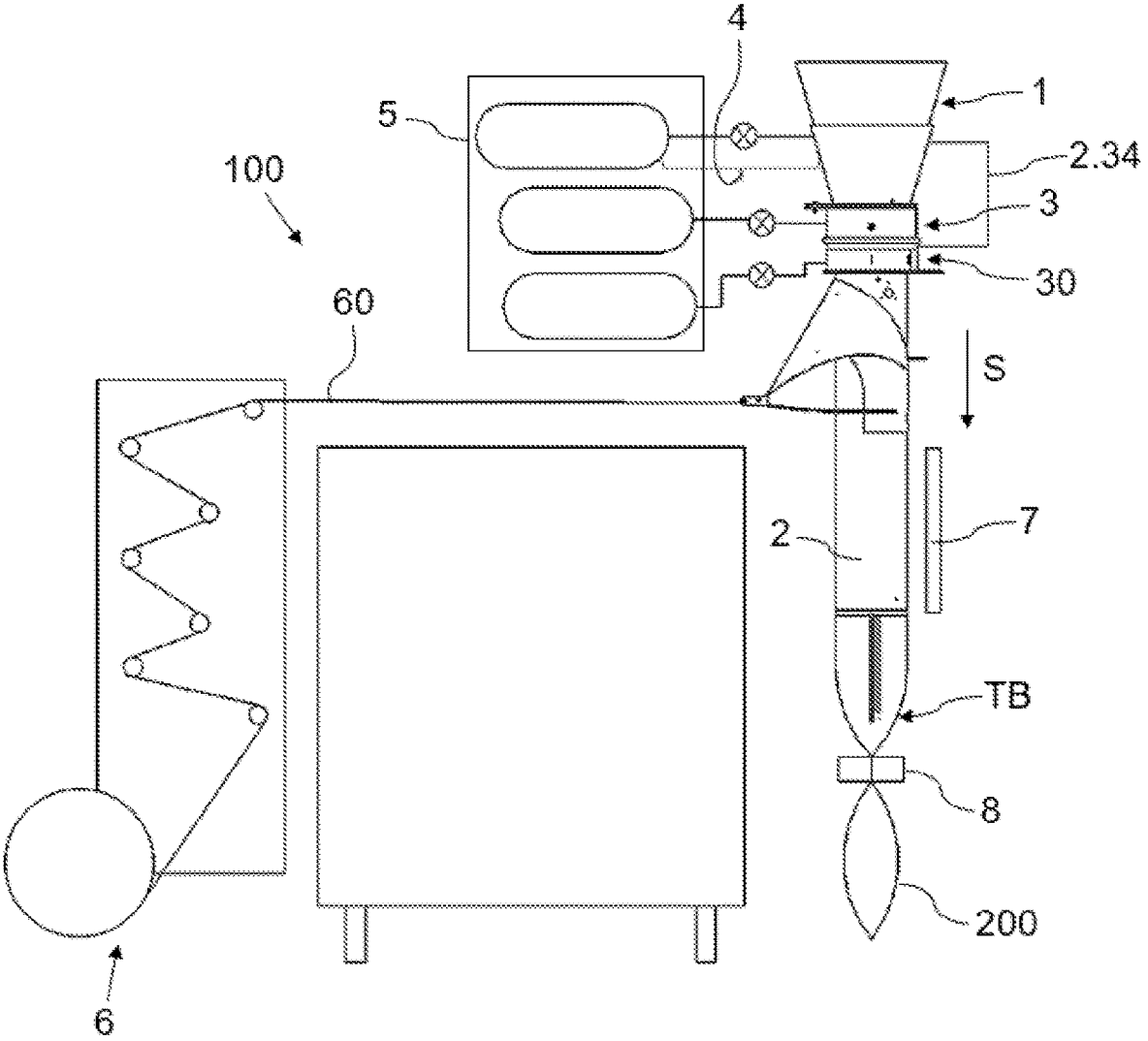
FIG. 1 is a simplified view of a vertical packaging machine according to one embodiment.
Figure 2:
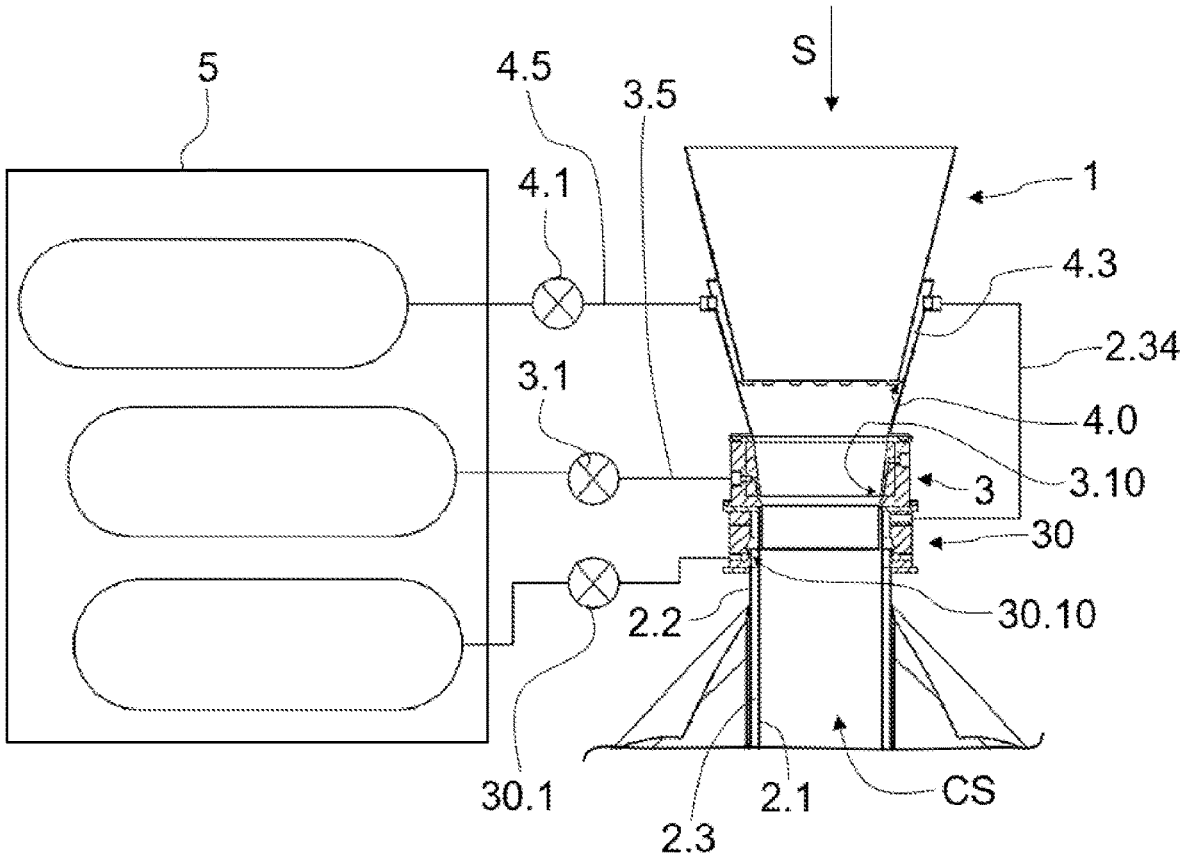
FIG. 2 shows a sectional view of some elements of the machine of FIG. 1.

FIGS. 1 and 2 show a vertical packaging machine 100 according to one embodiment, which is suitable for packaging products in a modified atmosphere. In the sector, vertical packaging machine 100 is known to comprise a vertical longitudinal axis or an axis inclined about 45° with respect to the vertical.

In any of its embodiments, the machine 100 comprises at least the following elements:

a hopper 1 through which the products to be packaged are introduced in a downward supply direction S, a hollow forming element 2 arranged downstream of the hopper 1 and, preferably, aligned with said hopper 1 in the supply direction S, at least the hopper 1 and the forming element 2 forming a supply conduit CS through which the product to be packaged falls, a feeder 6 for feeding a continuous film 60 around the forming element 2, the forming element 2 being configured to impart a tubular shape to the film, a longitudinal sealing tool 7 configured for longitudinally sealing together the longitudinal ends of the tubular-shaped film surrounding the forming element 2, a film tube TB being generated, and a transverse sealing and cutting tool 8 arranged downstream of the forming element 2 and configured for transversely sealing and cutting the film tube TB, a closed film tube TB upstream of the transverse cut and a closed package 200 physically separated from the film tube TB downstream of said transverse cut being generated, the corresponding product being packaged in the package 200.

As it relates to a vertical packaging machine the references "downstream" and "upstream" are to be interpreted with respect to the direction of the axis of the machine 100 (with respect to the supply direction S, which has been added in the drawings for clarity) which, as described above, can be vertical or at about 45° with respect to the vertical.

In any of its embodiments, the machine 100 further comprises an injection device 3 configured for injecting a gaseous fluid into the supply conduit CS, whereby achieving, for example, the acceleration of the fall of the product through the supply conduit CS, said gaseous fluid thereby entering the supply conduit CS at a given inlet point or area 3.10 of said supply conduit CS. The injection device 3 is configured for generating the Venturi effect inside the supply conduit CS when it injects the gaseous fluid into said supply conduit CS, such that a negative pressure is generated upstream of the inlet point or area 3.10 for the entry of said gaseous fluid in said supply conduit CS, as described above. Therefore, this injection can be used, for example, for suctioning the product upstream of the inlet point or area 3.10, preventing jams at the point furthest downstream of the hopper 1, for increasing the rate of fall of the product, and for compacting the product to be packaged at the closed end of the film tube TB, particularly when said product is of the type that scatters easily, such as leaves of lettuce, parsley, or spinach, for example, which saves the amount of film to be used for packaging them (amount of film in the package 200) and increases the speed of the packaging process.

To enable packaging products in a modified atmosphere, the machine 100 comprises a gas supply source 5 in any of its embodiments, the source 5 being communicated with the inside of the supply conduit CS by means of a supply unit 4 and said source 5 providing therefore a gas suitable for packaging products in modified atmosphere to said supply conduit CS. The modified atmosphere gas may be CO2 or N2, for example, or any other type of gas known for packaging products in a modified atmosphere. The source 5 can be a gas bottle, drum, or the like, or it can be a gas connection, for example.

Preferably, the supply unit 4 comprises at least one communication conduit 4.5 through which gas is supplied to the supply conduit CS from the source 5, and a regulating device 4.1 arranged in the communication conduit 4.5, such as a control valve, for example. The passage of gas from the source 5 to the supply conduit CS can be regulated by means of control over said regulating device 4.1. If the regulating device 4.1 is closed, preventing communication between the supply conduit CS and the source 5, then gas is not injected (nor is any other fluid), whereas if said regulating device 4.1 is opened, said injection is allowed. The regulating device 4.1 can be configured for being arranged in different positions in which it allows the passage of gas therethrough, the passage of different gas flow rates therethrough being allowed. The machine 100 preferably comprises a control device not depicted in the drawings for controlling the regulating device 4.1, thereby enabling control of the gas feed in the manner and at the time required. Preferably, the control device is configured for causing a continuous communication between the source 5 and the supply conduit CS through the communication conduit 4.5, supplying a constant gas flow rate to the supply conduit CS.

The supply conduit CS comprises at least one supply port 4.0 through which the gas from the source 5 enters said supply conduit CS, the supply port 4.0 being arranged upstream of the inlet point or area 3.10 for the gaseous fluid in said supply conduit CS. As a result of said arrangement of the supply port 4.0, when the injection device 3 injects the gaseous fluid into the supply conduit CS, said injection causes gas to be suctioned from the supply unit 4 into the supply conduit CS, facilitating said supply. Without said suction, the gas would try to get into the supply conduit CS but would be confronted with the fluid already present in said supply conduit CS, failing to assure the entry of the necessary amount of gas in said supply conduit CS for correct packaging in a modified atmosphere. The suction forces the gas to enter the supply conduit CS and arranges it inside the film tube TB, reducing the residual level of oxygen in the package 200 with said gas. The need to later introduce said gas by other means, as occurs in the state of the art, which could cause the previously compacted product to scatter, is thereby prevented; or to prevent this effect, the slowing down of production due to the need to introduce the gas smoothly and slowly, taking more time to reach the desired residual levels of oxygen or gas concentration, is prevented.

Preferably, the supply port 4.0 is furthermore oriented downward towards the supply conduit CS, with a very slight curvature or angle of incidence with respect to the supply conduit CS. This causes the gas to follow the contour of the supply conduit as a result of the Coandă effect, assuring to an even higher degree the entry of said gas in said supply conduit CS.

In some embodiments, the injection device 3 is communicated with a pressurized air source, such that the fluid which is injected into the supply conduit CS is pressurized air. These embodiments are useful for packaging products which require a low percentage of gas suitable for packaging in a modified atmosphere in the package 200 and/or less exigent residual oxygen.

However, in other embodiments the injection device 3 is communicated with the source 5, such that it is configured for the gaseous fluid it injects into the supply conduit CS to be gas coming from said source 5 and therefore gas suitable for packaging products in a modified atmosphere. These latter embodiments are thereby suitable at least for packaging products which require lower residual oxygen and/or a higher percentage of gas suitable for packaging in a modified atmosphere in the package 200, given that as a result of the injection device 3 injecting said gas, the amount of said gas in the packages 200 is higher compared to those embodiments in which air is injected with the injection device 3. Furthermore, this is achieved without needing to substantially modify the machine 100, because simply establishing communication between the injection device 3 and the source 5 is sufficient. The source 5 can be a gas connection, a gas bottle, drum, or the like, which is common both for the supply unit 4 and for the injection device 3, or it can comprise one gas bottle, drum, or the like for the supply unit 4 and another gas bottle, drum, or the like for the injection device 3.

Preferably, the injection device 3 is communicated with the source 5 by means of a communication conduit 3.5 and through a regulating device 3.1, such as a control valve. The passage of gas from the source 5 to the supply conduit CS can be regulated by means of control over said regulating device 3.1, and, therefore, the injection of gas into said supply conduit CS can be regulated by means of the injection device 3. If the regulating device 3.1 is closed, preventing communication between the injection device 3 and the source 5, then gas is not injected (nor is any other fluid), whereas if said regulating device 3.1 is opened, said injection is allowed. The regulating device 3.1 can be configured as an ON-OFF type regulating device, where it can be arranged in only two positions: open, in which it allows the passage of gas therethrough, but only with a given flow rate, and closed, in which it prevents the passage of any gas. Preferably, the regulating device can additionally regulate the gas flow rate which it injects into the supply conduit CS when it is arranged in the open position, the passage of different gas flow rates therethrough being allowed. In the event that the injection device 3 is communicated with a pressurized air source, the machine 100 may also comprise between said source and the injection device 3 a regulating device like the one mentioned.

In any of the embodiments of the machine 100 in which it comprises a regulating device 3.1, said regulating device 3.1 can be interpreted as part of the injection device 3 (preferred option) or as an additional element of the injection device 3.

The control device of the machine 100 is configured for controlling the actuation on the regulating device 3.1 arranged between the injection device 3 and the source 5, thereby enabling control of the injection of gas into the supply conduit CS in the manner and at the time required. For example, it can be controlled to keep the regulating device 3.1 open at all times, with a continuous gas flow being injected into the supply conduit CS, or an intermittent injection of gas into said supply conduit CS can be caused. Preferably, the control device is configured for causing an intermittent injection, causing one injection per product to be packaged (per package 200), thereby using less gas during the packaging process. Preferably, the control device of the machine 100 opens the regulating device 3.1 when the product is arranged upstream of the inlet point or area 3.10 and closes said regulating device 3.1 once all of the product to be packaged in a package 200 has passed the inlet point or area 3.10 in the supply direction S. Therefore, in addition to assuring the suction of the gas from the supply unit 4 to the supply conduit CS, the suction of the product upstream of the inlet point or area 3.10 is also caused, preventing jams in the point furthest downstream of the hopper 1, increasing the rate of fall of the product and compacting the product to be packaged, which saves the amount of film of the package 200 and increases the speed of the packaging process in a modified atmosphere.

In the embodiments in which the machine 100 comprises a regulating device 3.1 between the source 5 and the injection device 3 and a regulating device 4.1 in the communication conduit 4.5 of the supply unit 4, preferably, the control device is configured for controlling both regulating devices 3.1 and 4.1 in a coordinated manner. This coordination is particularly advantageous when an intermittent injection with the injection device 3 is required or implemented, and allows, for example, assuring to a greater extent that when gas is injected by means of said injection device 3 into the supply conduit CS, the necessary amount of gas is also fed from the feed unit 4 to said supply conduit CS.

In some embodiments, the forming element 2 is coaxial and comprises two concentric hollow elements 2.1 and 2.2 of different diameters, with a space 2.3 being defined between both elements 2.1 and 2.2. The space 2.3 is open at least at its most downstream point in the supply direction S to allow the gaseous fluid to exit the inside of the supply conduit CS through said space 2.3. This space 2.3 through which the exit of the gaseous fluid is allowed is particularly advantageous for the machine 100 since the injection device 3 is configured for generating the Venturi effect with the injection of the gaseous fluid. Preferably, said injection device 3 is configured for causing, with said injection, the suction of a gaseous fluid flow upstream of the inlet point or area 3.10, between 20 and 35 times greater than the injected gaseous fluid flow, due to said Venturi effect. This means that of the total gaseous fluid which is introduced in the supply conduit CS, between about 3% and 5% of the fluid corresponds to the fluid injected through the injection device 3, and the remaining 95-97% corresponds to the suctioned gas from the supply unit 4 (and/or atmospheric air in the event that the supply unit does not supply sufficient gas) due to the negative pressure generated by said injection. When the fluid injected by the injection device 3 causes the flow introduced in the supply conduit CS to generate an overpressure in the film tube TB (due to the fact that the film tube TB is closed at one end), the forming element 2 allows said flow to exit the supply conduit CS through the space 2.3 of the forming element 2, instead of exiting upwardly through the supply conduit CS. It is therefore possible to inject a larger gaseous fluid flow, with all the advantages mentioned above, at the same time preventing said gaseous fluid from exiting through the supply conduit CS upwardly, which would in turn prevent compaction and acceleration of the product to be packaged.

In some of these embodiments, the space 2.3 is furthermore communicated with the supply unit 4 through a communication conduit 2.34, such that once a product has been packaged, the gas suitable for packaging products in a modified atmosphere that may have been left over can reach said supply unit 4 and thus be reused, which could lead to less of said gas being consumed and product compaction improved.

Figure 3:
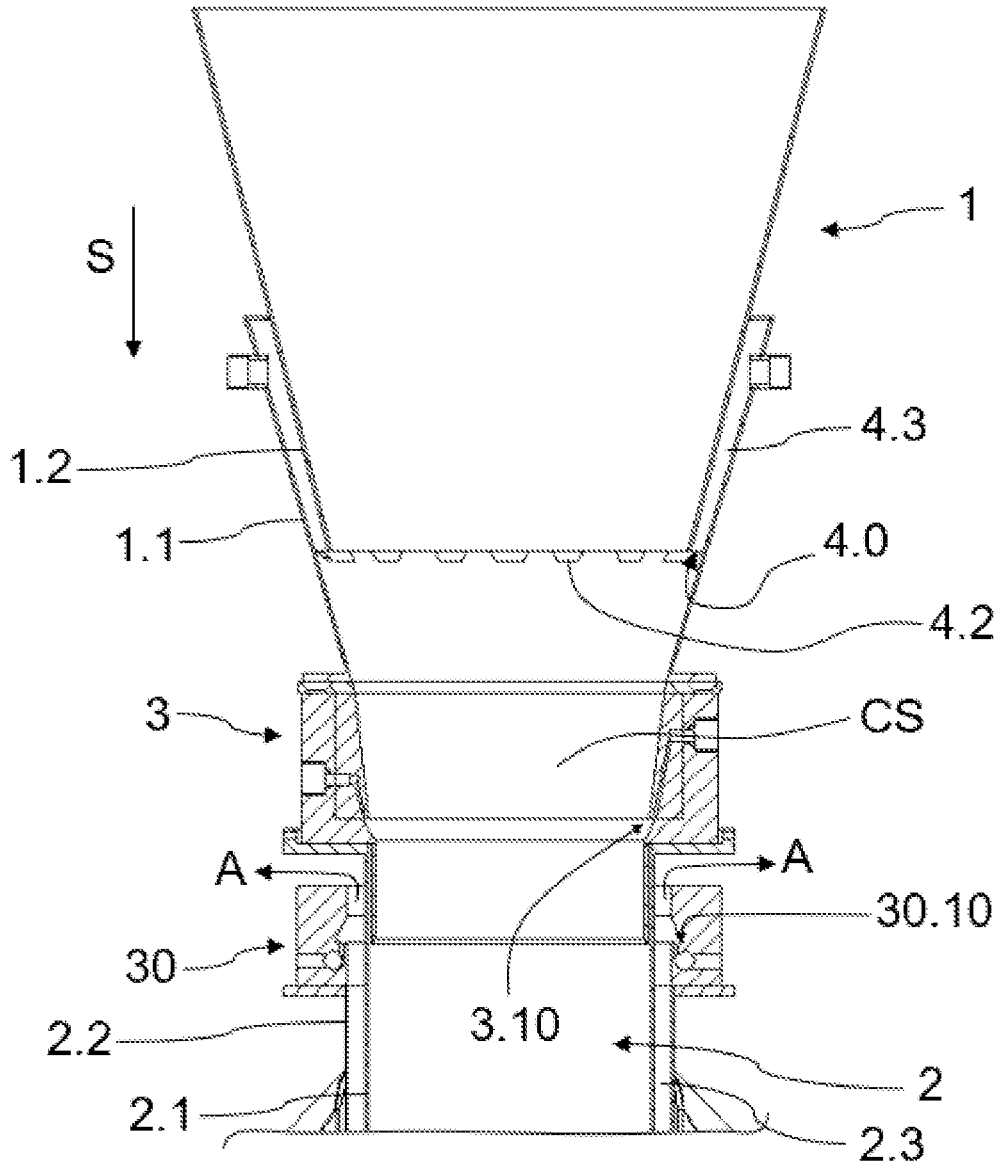
FIG. 3 is a sectional view of some elements of another embodiment of the machine, in which the forming element comprises two concentric elements and the space demarcated between both elements is communicated with the atmosphere.

In other embodiments of the machine 100 in which the forming element 2 is coaxial, the space 2.3 is open to the atmosphere (to the exterior of the machine 100) as shown in FIG. 3, where the outlet of the fluid into the atmosphere is identified with an arrow A. In these cases, the aim is to simply discharge the excess fluid that may remain in the film tube TB after packaging.

In some embodiments in which the forming element 2 is coaxial, the machine 100 comprises a second injection device 30 configured for injecting a gaseous fluid into said space 2.3, said second injection device 30 being configured for injecting said gaseous fluid upwardly into said space 2.3 and for causing a Venturi effect inside said space 2.3 as a result of said injection, such that a negative pressure is generated downstream of the inlet point or area 30.10 for the entry of said gaseous fluid in the space 2.3 (similar to the Venturi effect described above for injection device 3, but in the opposite direction). This injection causes the fluid in the vicinity of the end furthest downstream of the forming element 2 to be suctioned following the fluid injected, such that it is discharged from the film tube TB more quickly, either to be discharged into the atmosphere or for reuse in the supply unit 4 (through the communication conduit 2.34), depending on the corresponding configuration of the machine 100.

In some embodiments in which the forming element 2 is coaxial, particularly in some embodiments in which the space 2.3 is communicated with the supply unit 4 through a communication conduit 2.34, the second injection device 30 is communicated with the source 5, such that the injected fluid is gas suitable for packaging in a modified atmosphere. Preferably, the second injection device 30 is communicated with the source 5 through a regulating device 30.1, such as a control valve, such that the injection can be controlled as in the case of regulating device 3.1 that has been described. The control device of the machine 100 can furthermore be configured for coordinating the actuation of all the regulating devices 30.1, 3.1, and 4.1 that the machine 100 may have, preferably for coordinating the regulating devices 30.1 and 3.1 such that both fluid injections occur simultaneously.

In some embodiments in which the forming element 2 is coaxial, particularly in some embodiments in which the space 2.3 is communicated with the atmosphere (with the outside of the machine 100), the injection device 30 is communicated with the pressurized air source, preferably through a regulating device such as a control valve, such that the injection can be controlled like in the case of regulating device 3.1 that has been described. In these embodiments, the control device of the machine 100 can furthermore be configured for coordinating the actuation of all the regulating devices that the machine 100 may have, preferably for coordinating the regulating device through which the injection device 30 and the source of air and the regulating device 3.1 are communicated, such that both fluid injections occur simultaneously.

In some examples that are not part of the invention, the machine 100 may comprise the two injection devices 3 and 30 for packaging products without a modified atmosphere when, for example, gas is not supplied through the supply unit 4 and the fluid injected by said injection devices 3 and 30 is air. In other examples that are not part of the invention and in which gas suitable for packaging in a modified atmosphere is not supplied, the machine 100 can therefore dispense with the supply source 5 and the described elements communicating said source 5 with the injection devices 3 and 30.

In some embodiments of the machine 100, the supply unit 4 comprises a store 4.3 arranged between the communication conduit 4.5 and the supply conduit CS. This allows having a larger amount of gas available in the supply unit 4 for the supply thereof to the supply conduit CS, which assures to a greater extent that gas suitable for packaging in a modified atmosphere will be introduced when it is required and in a sufficient amount. These embodiments are particularly advantageous when the space 2.3 of the coaxial forming tube 2 is communicated with the supply unit 4 through the communication conduit 2.34.

In some embodiments, the store 4.3 comprises at least one deflector 4.2 for causing at least part of the fluid which is fed from said store 4.3 to the supply conduit CS to be introduced into said supply conduit CS through the supply port 4.0 such that it flows towards the center of said supply conduit CS. It is thereby assured that the gas suitable for packaging in a modified atmosphere does not flow only on the periphery of the supply conduit CS, being supplied in a more homogeneous manner and preventing the suction caused by the injection device 3 when it injects gaseous fluid into the supply conduit CS from introducing atmospheric air in the supply conduit CS.

In some embodiments, the hopper 1 comprises at least one outer wall 1.1 and an inner wall 1.2 which are concentric and separated from one another such that a space is defined, said space being the store 4.3. The length of the outer wall 1.1 superimposed with the inner wall 1.2 and the separation between both walls 1.1 and 1.2 define the volume of the store 4.3, so it can be configured as required depending on the volume required for said store 4.3. This configuration of the store 4.3 facilitates the manufacture of the machine 100, while at the same time assuring proper arrangement of the supply port 4.0 of said store 4.3 in a simple manner. The hopper 1 therefore defines a gap demarcated by the inner wall 1.2 through where the product to be packaged is supplied, and a space between both walls 1.1 and 1.2 forming the store 4.3. The supply port 4.0 is preferably arranged at a lower end of said store 4.3, and the outer wall 1.1 preferably extends downstream of the supply port 4.0, functioning as a hopper 1 until reaching the dimensions of the forming element 2 or injection device 3 (the diameter or perimeter of said forming element 2 or injection device 3).

In the embodiments in which the supply unit 4 comprises a store 4.3, the forming element 2 is coaxial and the space 2.3 is communicated with the supply unit 4 through a communication conduit 2.34, said communication conduit 2.34 extending from said space 2.3 to the store 4.3. Furthermore, said communication conduit 2.34 preferably extends from the point furthest upstream of the space 2.3.

In a preferred embodiment, the machine 100 comprises a supply unit 4 with a store 4.3, an injection device 3 communicated with the source 5, a forming element 2 coaxial with the space 2.3 communicated with the inside of the store 4.3, and an injection device 30 communicated with the source 5 and with the space 2.3. In said preferred embodiment, the store 4.3 is formed by an outer wall 1.1 and an inner wall 1.2 of the hopper 1 which are concentric and separated from one another, wherein the supply port 4.0 is arranged at a lower end of said store 4.3 and the outer wall 1.1 extends downstream of the supply port 4.0.

These and other embodiments are disclosed in the clauses that follow:

Clause 1. Vertical packaging machine for packaging products in a modified atmosphere, comprising a hopper (1) through which the products to be packaged are introduced, a hollow forming element (2) arranged downstream of the hopper (1), at least the hopper (1) and the forming element (2) forming a supply conduit (CS) through which the product to be packaged falls, a feeder (6) for feeding a continuous film (60) around the forming element (2), the forming element (2) being configured to impart a tubular shape to said film (60), a sealing tool (7) configured for longitudinally sealing together the longitudinal ends of the tubular-shaped film, a film tube (TB) being generated, a sealing and cutting tool (8) arranged downstream of the forming element (2) and configured for transversely sealing and cutting the film tube (TB), obtaining a transversely closed film tube (TB) upstream of the transverse cut, and a closed package (200) physically separated from the film tube (TB) downstream of the transverse cut, and an injection device (3) configured for injecting a gaseous fluid into the supply conduit (CS), the injection device (3) is configured for causing the Venturi effect to be generated inside the supply conduit (CS) when it injects the gaseous fluid into said supply conduit (CS) through an inlet point or area (3.10) of the supply conduit (CS), a negative pressure upstream of said inlet point or area (3.10) being generated, the machine (100) comprising a gas source (5) configured for supplying gas suitable for packaging products in a modified atmosphere, and a supply unit (4) communicating the source (5) with the inside of the supply conduit (CS) through at least one supply port (4.0) of said supply conduit (CS), said supply port (4.0) being arranged upstream of the inlet point or area (3.10) of the supply conduit (CS), such that when the injection device (3) injects the gaseous fluid into the supply conduit (CS), said injection causes gas to be suctioned from the supply unit (4) into said supply conduit (CS).

Clause 2. Vertical packaging machine according to clause 1, wherein the injection device (3) is communicated with the source (5), such that it is configured for the gaseous fluid it injects into the supply conduit (CS) to be gas suitable for packaging products in a modified atmosphere coming from said source (5).

Clause 3. Vertical packaging machine according to clause 1 or 2, wherein the forming element (2) comprises two concentric hollow elements (2.1, 2.2) of different diameters, a space (2.3) being defined between both elements (2.1, 2.2) and said space (2.3) being open at its most downstream point to allow the gaseous fluid to exit the inside of the supply conduit (CS) through said space (2.3).

Clause 4. Vertical packaging machine according to clause 3, wherein the space (2.3) is communicated with the supply unit (4), such that the gaseous fluid exiting the supply conduit (CS) through said space (2.3) is introduced into the supply conduit (CS) through the supply unit (4).

Clause 5. Vertical packaging machine according to clause 3 or 4, comprising a second injection device (30) configured for injecting a gaseous fluid into the space (2.3) defined between the two concentric elements (2.1, 2.2) of the forming element (2), said second injection device (30) being configured for injecting said gaseous fluid upwardly into said space (2.3) and for causing a Venturi effect inside said space (2.3) as a result of said injection, such that a negative pressure is generated downstream of the inlet point or area (30.10) for the entry of said gaseous fluid in the space (2.3).

Clause 6. Vertical packaging machine according to clause 5, wherein the second injection device (30) is communicated with the source (5), such that it is configured for the gaseous fluid it injects into the space (2.3) to be gas suitable for packaging products in a modified atmosphere coming from said source (5).

Clause 7. Vertical packaging machine according to clause 5 or 6, wherein the second injection device (30) is communicated with the source (5) through a regulating device (30.1).

Clause 8. Vertical packaging machine according to any of clauses 1 to 7, wherein the supply unit (4) comprises a communication conduit (4.5) communicating the source (5) with the inside of the supply conduit (CS) and a store (4.3) arranged between said communication conduit (4.5) and the supply conduit (CS).

Clause 9. Vertical packaging machine according to clause 8, wherein the store (4.3) comprises at least one deflector for causing at least part of the gas being fed to the supply conduit (CS) from the store (4.3) to be introduced into said supply conduit (CS) through the supply port (4.0) such that it flows towards the center of said supply conduit (CS).

Clause 10. Vertical packaging machine according to clause 8 or 9, wherein the hopper (1) comprises an outer wall (1.1) and an inner wall (1.2), said walls (1.1, 1.2) being concentric and said walls (1.1, 1.2) being separated from one another such that they define a space therebetween, said space comprising the supply port (4.0) and said space being the store (4.3).

Clause 11. Vertical packaging machine according to any of clauses 1 to 10, wherein the injection device (3) is communicated with the source (5) through a regulating device (3.1), and wherein the supply unit (4) comprises a regulating device (4.1) arranged between the supply port (4.0) and the supply source (5), the machine (100) comprising a control device communicated with both regulating devices (3.1, 4.1) and configured for controlling regulation of both regulating devices (3.1, 4.1).

Clause 12. Vertical packaging machine according to clause 11, wherein the control device is configured for controlling regulation of the regulating devices (3.1, 4.1, 30.1) in a coordinated manner.

What is claimed is:

1. A vertical packaging machine for producing packages made from a film, and for packaging a product in the packages with a modified atmosphere gas, the vertical packaging machine comprising:

a hopper through which the product to be packaged is introduced;

a hollow forming element arranged downstream of the hopper and configured to impart a tubular shape to the film, at least the hopper and the forming element forming a supply conduit through which the product to be packaged falls;

a sealing tool configured to longitudinally seal together first and second longitudinal ends of the tubular-shaped film to create a film tube;

a sealing and cutting tool arranged downstream the hollow forming element and configured to transversely seal and cut the film tube to obtain a transversely closed film tube upstream of the transverse cut, and a closed package physically separated from the film tube downstream the transverse cut;

a first injection device configured to inject a gaseous fluid into an inlet area of the supply conduit in a manner that causes the Venturi effect to be generated inside the supply conduit to cause a negative pressure to be generated upstream of the inlet area of the supply conduit;

a gas source configured to supply the modified atmosphere gas;

a supply port through which the modified atmosphere gas is introduced into the supply conduit, the supply port being located upstream the inlet area of the supply conduit; and a supply unit communicating the gas source with the supply port;

when the injection device injects the gaseous fluid into the inlet area of the supply conduit, the modified atmosphere gas is suctioned from the supply unit into the supply conduit through the supply port;

the hollow forming element comprising first and second hollow elements that are arranged concentric to one another and sized so that a space is defined between them, the space being open at its most downstream point to allow the gaseous fluid to exit the inside of the supply conduit through the space.

2. The vertical packaging machine according to claim 1, wherein the gaseous fluid is pressured air.

3. The vertical packaging machine according to claim 1, wherein the first injection device is communicated with the gas source, the gaseous fluid being the modified atmosphere gas.

4. The vertical packaging machine according to claim 1, wherein the space is communicated with the supply unit, such that at least a portion of the gaseous fluid exiting the supply conduit through the space is reintroduced into the supply conduit through the supply unit.

5. The vertical packaging machine according to claim 1, further comprising a second injection device configured to inject the gaseous fluid into the space defined between the first and second hollow elements of the forming element, the second injection device being configured to inject the gaseous fluid upwardly into the space and to cause the Venturi effect inside the space such that a negative pressure is generated downstream of the inlet area of the supply conduit.

6. The vertical packaging machine according to claim 5, wherein the second injection device is communicated with the gas source, the gaseous fluid being the modified atmosphere gas.

7. The vertical packaging machine according to claim 6, wherein the second injection device is communicated with the gas source through a regulating device.

8. The vertical packaging machine according to claim 5, wherein the first injection device is communicated with the gas source through a first regulating device, and wherein the supply unit includes a second regulating device arranged between the supply port and the gas source.

9. The vertical packaging machine according to claim 8, further comprising a control device that is configured to operate the first and second regulating devices in a coordinated manner.

10. The vertical packaging machine according to claim 8, wherein the second injection device is communicated with the gas source through a third regulating device.

11. The vertical packaging machine according to claim 10, further comprising a control device that is configured to operate the first, second and third regulating devices in a coordinated manner.

12. The vertical packaging machine according to claim 1, wherein the supply unit comprises a communication conduit communicating the gas source with an inside of the supply conduit and a store arranged between the communication conduit and the supply conduit.

13. The vertical packaging machine according to claim 12, wherein the store comprises at least one deflector for causing at least part of the modified atmosphere gas to be directed towards a center portion of the supply conduit from the store.

14. The vertical packaging machine according to claim 12, wherein the hopper comprises an outer wall and an inner wall that are separated from one another such that a space resides between them, the space between the outer and inner wall defining the store and having a downstream outlet comprising the supply port.

15. The vertical packaging machine according to claim 1, wherein the first injection device and supply unit are configured such that a total of fluid introduced into the supply conduit constitutes 3% to 5% of the gaseous fluid and 95% to 97% of the suctioned modified atmosphere gas.

16. The vertical packaging machine according to claim 1, wherein the space is open to the atmosphere.

17. A vertical packaging machine for producing packages made from a film, and for packaging a product in the packages with a modified atmosphere gas, the vertical packaging machine comprising:

a hopper through which the product to be packaged is introduced;

a hollow forming element arranged downstream of the hopper and configured to impart a tubular shape to the film, at least the hopper and the forming element forming a supply conduit through which the product to be packaged falls;

a sealing tool configured to longitudinally seal together first and second longitudinal ends of the tubular-shaped film to create a film tube;

a sealing and cutting tool arranged downstream the hollow forming element and configured to transversely seal and cut the film tube to obtain a transversely closed film tube upstream of the transverse cut, and a closed package physically separated from the film tube downstream the transverse cut;

a first injection device configured to inject pressurized air into an inlet area of the supply conduit in a manner that causes the Venturi effect to be generated inside the supply conduit to cause a negative pressure to be generated upstream of the inlet area of the supply conduit;

a gas source configured to supply the modified atmosphere gas;

a supply port through which the modified atmosphere gas is introduced into the supply conduit, the supply port being located upstream the inlet area of the supply conduit; and a supply unit communicating the gas source with the supply port;

when the injection device injects the pressurized air into the inlet area of the supply conduit, the modified atmosphere gas is suctioned from the supply unit into the supply conduit through the supply port.

18. A vertical packaging machine for producing packages made from a film, and for packaging a product in the packages with a modified atmosphere gas, the vertical packaging machine comprising:

a hopper through which the product to be packaged is introduced;

a hollow forming element arranged downstream of the hopper and configured to impart a tubular shape to the film, at least the hopper and the forming element forming a supply conduit through which the product to be packaged falls;

a sealing tool configured to longitudinally seal together first and second longitudinal ends of the tubular-shaped film to create a film tube;

a sealing and cutting tool arranged downstream the hollow forming element and configured to transversely seal and cut the film tube to obtain a transversely closed film tube upstream of the transverse cut, and a closed package physically separated from the film tube downstream the transverse cut;

a first injection device configured to inject a gaseous fluid into an inlet area of the supply conduit in a manner that causes the Venturi effect to be generated inside the supply conduit to cause a negative pressure to be generated upstream of the inlet area of the supply conduit;

a gas source configured to supply the modified atmosphere gas;

a supply port through which the modified atmosphere gas is introduced into the supply conduit, the supply port being located upstream the inlet area of the supply conduit; and a supply unit communicating the gas source with the supply port;

when the injection device injects the gaseous fluid into the inlet area of the supply conduit, the modified atmosphere gas is suctioned from the supply unit into the supply conduit through the supply port:

the first injection device and supply unit being configured such that a total of fluid introduced into the supply conduit constitutes 3% to 5% of the gaseous fluid and 95% to 97% of the suctioned modified atmosphere gas.

* * * * *